US005343929A

United States Patent [19]

Landua et al.

[11] Patent Number: 5,343,929

[45] Date of Patent: Sep. 6, 1994

[54] APPARATUS FOR DEBURRING FOUNDRY CORES AND SIMILAR WORKPIECES

[75] Inventors: Werner Landua, Mannheim; Werner Pichler, Brühl, both of Fed. Rep. of Germany

[73] Assignee: Adolf Hottinger Maschinenbau GmbH, Mannheim-Rheinau, Fed. Rep. of Germany

[21] Appl. No.: 915,997

[22] PCT Filed: Jan. 18, 1991

[86] PCT No.: PCT/DE91/00036

§ 371 Date: Jul. 30, 1992

§ 102(e) Date: Jul. 30, 1992

[87] PCT Pub. No.: WO91/11280

PCT Pub. Date: Aug. 8, 1991

[30] Foreign Application Priority Data

Jan. 30, 1990 [DE] Fed. Rep. of Germany ..... 4002555

[51] Int. Cl.[5] ..... B22C 9/10; B22C 23/00

[52] U.S. Cl. ..... 164/262; 164/412; 164/6; 15/94

[58] Field of Search ..... 164/6, 159, 262, 270.1, 164/412; 15/93.1, 94; 51/310, 59 R, 59 SS, 64

[56] References Cited

U.S. PATENT DOCUMENTS

| | | | |
|---|---|---|---|
| 2,333,304 | 11/1943 | Ernst et al. | 51/64 |
| 2,648,170 | 8/1953 | Esters | 51/59 R |
| 4,030,188 | 6/1977 | Reiland . | |
| 4,590,636 | 5/1986 | Wehrmann | 15/94 |
| 4,844,141 | 7/1989 | Trumbauer et al. | 164/262 |

FOREIGN PATENT DOCUMENTS

| | | | |
|---|---|---|---|
| 416782 | 7/1925 | Fed. Rep. of Germany . | |
| 0266752 | 4/1989 | Fed. Rep. of Germany | 164/262 |
| 1590395 | 5/1970 | France . | |
| 2503011 | 10/1982 | France . | |
| 2548940 | 1/1985 | France . | |
| 0232041 | 10/1986 | Japan | 164/262 |
| 0104750 | 5/1988 | Japan | 164/262 |
| 0144844 | 6/1988 | Japan | 164/262 |
| 0138055 | 5/1989 | Japan | 164/262 |
| 0910351 | 3/1982 | U.S.S.R. | 164/262 |

*Primary Examiner*—P. Austin Bradley
*Assistant Examiner*—Erik R. Puknys
*Attorney, Agent, or Firm*—Bell, Seltzer, Park & Gibson

[57] ABSTRACT

An apparatus for deburring foundry cores (3) and similar workpieces, comprising a vibration device, a stationary base (10) which carries the vibration device, and a deburring template (4), is designed and constructed for an effective deburring with a reduced risk of damage to the workpiece, and with less wear on tools such that the vibrating movement of the vibration device occurs exclusively in vertical direction, and that a clearance is absent between the contours of the cores (3) to be deburred and the contours of the deburring template (4), so that the burr is cut off as the core (3) passes through the deburring template (4).

7 Claims, 2 Drawing Sheets

APPARATUS FOR DEBURRING FOUNDRY CORES AND SIMILAR WORKPIECES

Figure 1:
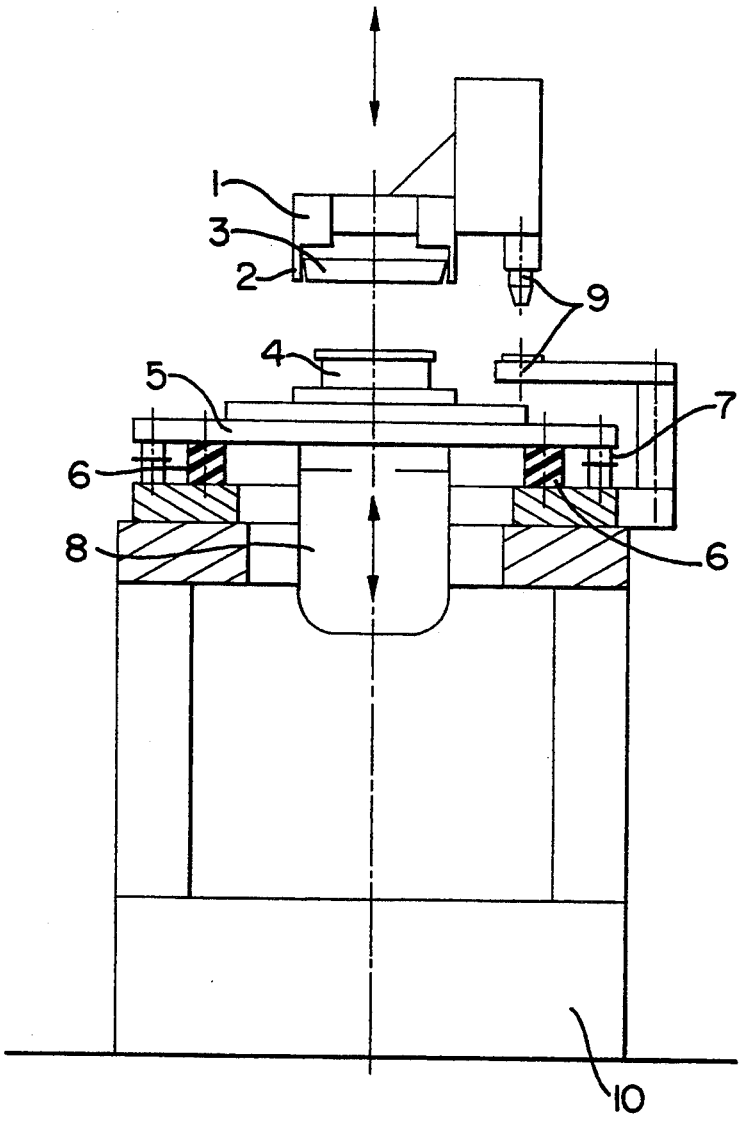

The invention relates to an apparatus for deburring foundry cores and similar workpieces, comprising a vibration device, a stationary base carrying the vibration device, and a deburring template.

U.S. Pat. No. 4.590,636 discloses an apparatus of the above-described kind, in which the burr of the foundry core is hammered off by a vibrating movement. To realize the hammering movement of a debutting template, an adequate clearance is present between the latter and the core to be deburred. Depending on the formation of the burrs on the core, the vibrating movement to be realized there is a composite movement, so that the burrs are hammered off all around by the deburring template. Apart from the fact that automation of operations is rendered impossible, the known apparatus is further problematic, inasmuch as the burr on the sand core which possesses mostly little strength, is vibrated or hammered off by a shock effect. Such a removal of burrs endangers the core considerably and leads, as a result of periodically occurring pulses, to the necessity of a costly mechanism for avoiding transmissions of vibration.

Based on the problems arising in the state of the art with respect to the deburring operations subjecting both the tool and the workpiece to considerable stress, the teaching of the invention is based on the object of configuring and further developing the known apparatus for deburring foundry cores and similar workpieces such that an effective removal of burrs is accomplished with simple technical means and reduced wear on tools and without pulses produced by hammering.

The apparatus of the present invention, in which the aforesaid problem is solved, is characterized in that the vibrating movement of the vibration device occurs exclusively in vertical direction, and that a clearance is absent between the contours of the core to be deburred and the contours of the deburring template, so that the burr is cut off as the core passes through deburring template.

In accordance with the invention, it has been recognized that an excessive pulsating or beating of the apparatus can be avoided in that the burr is not removed by hammering, but rather is cut off. To this end, the vibration device is designed in a manner in accordance with the invention so that the vibrating movement of the vibration device occurs exclusively in vertical direction, there being no clearance between the contours of the core to be deburred and the contours of the deburring template. Accordingly, the edge of the deburring template acts like a cutting tool which severs the burr from the core in the course of the vibrating movement.

As regards an accurate adaptation of the vibrating movement to the burr to be cut off respectively, it is of special advantage, when the amplitude of the vibration device is preferably infinitely variable.

As regards an adjustment of the deburring template, it is of further advantage, when the deburring template is adjustable by means of setting screws in two axial directions. As a result, it will be avoided that not only the burr, but also the periphery of the core is cut or scraped off.

In a special embodiment, the vibration device comprises a vibrating part with a magnetic vibrator. Further, a vibrating plate with buffers is provided, wherein the buffers serve to damp the vibrating movement. To effectively prevent the vibrating plate from veering sideways, a leaf spring is provided which permits the vibration device or respectively the vibrating plate to perform a vibrating movement exclusively in vertical direction.

Likewise, it is possible to provide in an advantageous manner several deburring templates for simultaneously deburring several cores, which increases substantially the throughput in particular in an automatic operation.

Of special advantage is, in particular under the aspect of an automatic operation of the apparatus under discussion, when a handling device with elastic grippers is provided, which cooperates with the vibration device. This handling device serves to carry out automatically the operations from the removal of cores ejected from a core die, via the placement of the cores into the deburring template, to the further transportation of the cores for subsequent handling. The provision of such a handling device permits automatic manipulations, with the elasticity of the grippers preventing damage to the foundry cores or the like.

In a further advantageous manner, a guide mechanism is provided which is operative between the handling device and the base carrying the vibration device. This guide mechanism allows to ensure that the workpiece to be deburred can be placed accurately into the deburring template and be moved out again without damage to the workpiece. Furthermore, the holding of the core in the grippers is made flexible, which again lessens considerably the risk of damaging the workpiece to be deburred.

Figure 2:
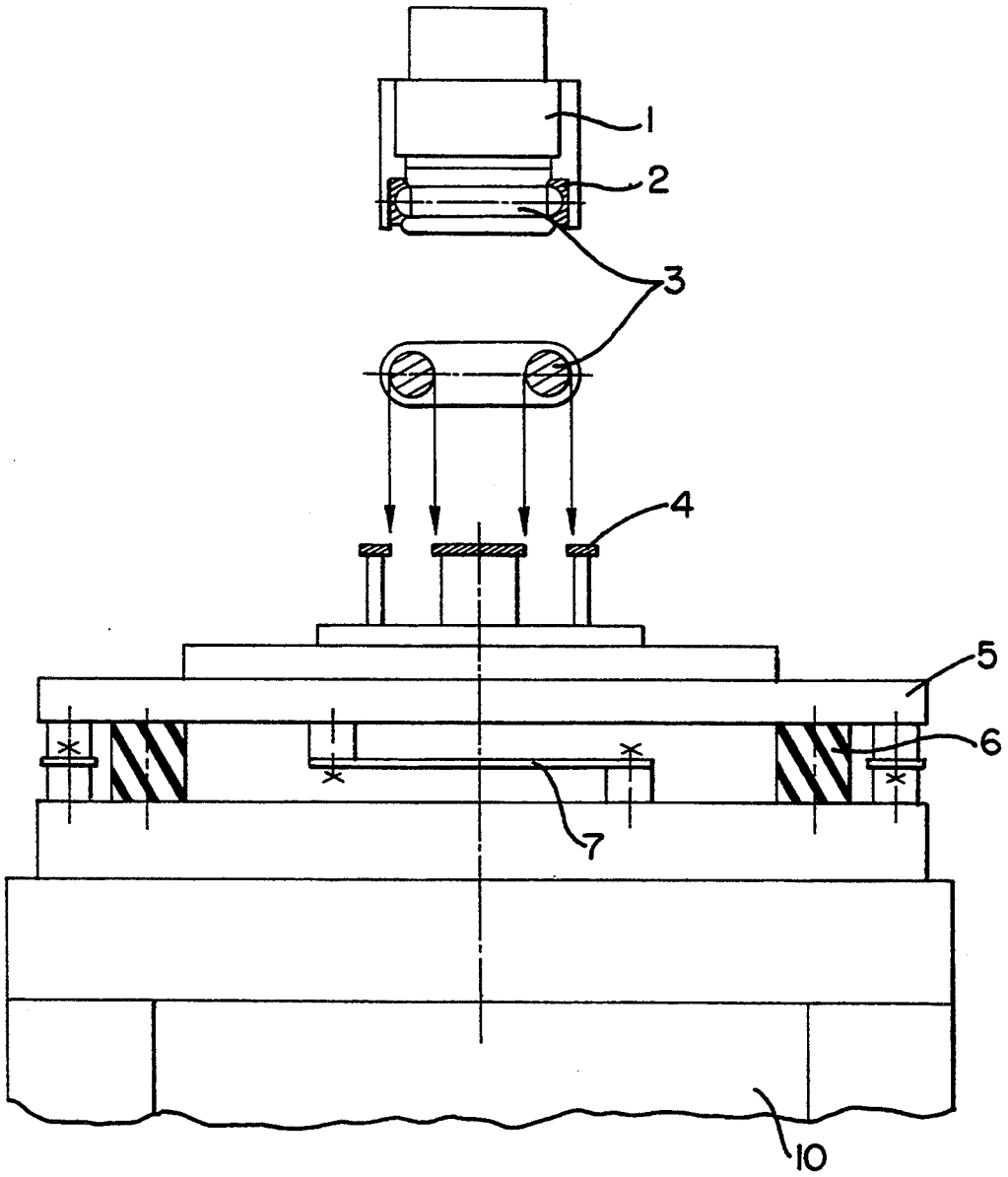

Two possibilities exist to configure and further develop the teaching of the present invention in an advantageous manner. To this end, reference is made to the following detailed description of an embodiment of the present invention in conjunction with the drawing, in which:

FIG. 1 is a schematic view of an embodiment of an apparatus in accordance with the invention for deburring foundry cores; and FIG. 2 shows an apparatus of FIG. 1 rotated by 90° about a vertical axis.

The apparatus for deburring foundry cores 3 as shown in FIGS. 1 and 2, comprises a handling device 1 with elastic grippers 2 to receive the foundry cores 3. The foundry cores 3 are automatically removed by means of the handling device 1 from a core die not shown in the Figures, and brought over a deburring device comprising a deburring template 4. Arranged on a stationary base 10 is a vibrating part with a magnetic vibrator 8, a vibrating plate 5, with buffers 6, and with leaf springs 7. The deburring template 4 is also associated to the base 10.

As the core 3 passes through the deburring template 4, the handling device 1 is guided in the stationary part or respectively base 10 such that the burr is in a way cut off. A guide mechanism 9 is operative between the base 10 and the handling device 1.

Finally, it should be noted that the gist of the present invention, namely deburring by cutting the burr off, is by no means limited to the foregoing embodiment which has been described only by way of example.

That which is claimed is:

1. An apparatus for removing burrs which protrude from the peripheral edge of a workpiece and comprising a template having a rigid internal profile which closely conforms to the entire outline of the peripheral edge of the workpiece, with no significant clearance therebetween, means for supporting the workpiece so that the peripheral edge of the workpiece is aligned in a predetermined direction with said internal profile of said template, means for vibrating said template so that the template moves exclusively along said predetermined direction, and means for guiding said workpiece supporting means for linear movement along said predetermined direction and so that the supported workpiece moves through said internal profile of the template and so that the internal profile acts to sever the protruding burrs from the peripheral edge of the workpiece.

2. The apparatus as defined in claim 1 wherein said means for vibrating said template includes means for selectively varying the amplitude of the vibrations.

3. The apparatus as defined in claim 1 further comprising a rigid base, and a plate supporting said template, and wherein said means for vibrating said template comprises means mounting said plate to said base so that said plate can move exclusively in said predetermined direction with respect to said base, and vibrator means connected to said plate.

4. The apparatus as defined in claim 3 wherein said means mounting said plate to said base comprises a plurality of leaf springs and a plurality of buffers.

5. The apparatus as defined in claim 3 wherein said guiding means includes cooperating male and female members mounted to respective ones of said workpiece supporting means and said base.

6. The apparatus as defined in claim 1 wherein said workpiece supporting means includes elastic grippers for engaging said workpiece.

7. A method for deburring a workpiece such as a molded foundry core comprising the steps of providing a workpiece having burrs which protrude from the peripheral edge thereof, providing a template having a fixed internal profile which closely conforms to the entire outline of said peripheral edge of the workpiece, with no significant clearance therebetween, supporting the workpiece and the template so that the peripheral edge of the workpiece is aligned in a predetermined direction with said internal profile of said template, vibrating said template so that the template moves exclusively along said predetermined direction, and guiding said workpiece supporting means for linear movement along said predetermined direction and so that the supported workpiece moves through said internal profile of the vibrating template and the internal profile acts to sever the protruding burrs from the peripheral edge of the workpiece.

* * * * *